US009253558B2

(12) United States Patent
Yuen

(10) Patent No.: US 9,253,558 B2
(45) Date of Patent: Feb. 2, 2016

(54) HEADPHONE

(71) Applicant: INNOVATION SOUND TECHNOLOGY CO., LTD., Shenzhe, Guangdong (CN)

(72) Inventor: Shunming Yuen, Hong Kong (CN)

(73) Assignee: INNOVATION SOUND TECHNOLOGY CO., LTD., Guangdong, CA (US)

( * ) Notice: Subject to any disclaimer, the term of this patent is extended or adjusted under 35 U.S.C. 154(b) by 0 days.

(21) Appl. No.: 14/438,767

(22) PCT Filed: Oct. 26, 2012

(86) PCT No.: PCT/CN2012/083568

§ 371 (c)(1),
(2) Date: Apr. 27, 2015

(87) PCT Pub. No.: WO2014/063345

PCT Pub. Date: May 1, 2014

(65) Prior Publication Data

US 2015/0256918 A1 Sep. 10, 2015

(51) Int. Cl.
*H04R 25/00* (2006.01)
*H04R 1/10* (2006.01)

(52) U.S. Cl.
CPC ..... *H04R 1/10* (2013.01); *H04R 1/1033* (2013.01); *H04R 1/105* (2013.01)

(58) Field of Classification Search
CPC .. H04R 1/1008; H04R 1/1016; H04R 1/1025; H04R 1/1033; H04R 1/1041; H04R 1/1058; H04R 1/1066; H04R 1/1075; H04R 1/10; H04R 5/033; H04R 5/0335; H04R 2201/023; H04M 1/6058
USPC ..... 381/370, 371, 374, 376, 377, 383, 384
See application file for complete search history.

(56) References Cited

U.S. PATENT DOCUMENTS 8,363,875 B2 * 1/2013 Ito ..... H04R 1/1066 381/379
2007/0223766 A1 * 9/2007 Davis ..... H04M 1/05 381/379
2012/0099754 A1 * 4/2012 Petersen ..... H04R 1/1066 381/379

FOREIGN PATENT DOCUMENTS

CN 1561082 A 1/2005
CN 202218373 U 5/2012

OTHER PUBLICATIONS

International Search Report for International Application No. PCT/CN2012/083568 dated Aug. 1, 2013 with English translation.

*Primary Examiner* — Brian Ensey
(74) *Attorney, Agent, or Firm* — Fitch, Even, Tabin and Flannery LLP

(57) ABSTRACT

The utility model provides a headphone, comprising a headband, left and right two ear pads and a holder. Two ends of the headband are separately provided with a fixing component, the fixing component includes a conductor block; the holder is made of the conductive material, of which one end is respectively connected with the left and right two ear pads fixedly and the other end is respectively connected with the fixing components in a sliding way, and the conductor block is pressed against the holder; in the ear pads, the first group of signal wires is connected to the holder electrically; in the fixing components, the second group of signal wires is connected with the conductor block electrically. The headphone provided in the utility model replaces the exposed lead with the conductive holder which is used as the medium for the audio signal transfer between the left and right two ear pads, thus eliminating the exposed lead on the headphone, simplifying the structure and avoiding the risk of broken circuit due to the damage of the exposed lead in use previously.

10 Claims, 2 Drawing Sheets

HEADPHONE

FIELD OF THE INVENTION

The utility model relates to an earphone, in particular to a headphone.

BACKGROUND OF THE INVENTION

The existing headphone, as shown FIG. 1 comprises left and right two ear pads 1', a headband 2' and a holder 3'. The ear pads 1' separately cover the ears of the user and are internally provided with speakers for playing audio to the ears of the user. The headband 2' is designed to be approximately arched to suit the human head outline, of which two ends are respectively provided with a fixing component 4', one end of the holder 3' passes through the fixing component 4' to connect with the fixing component 4' in a relatively sliding way, the other end of the holder 3'is connected with the ear pad 1'. The holder 3'can slide on the fixing component 4' to drive the ear pads 1' to slide such that different users can adjust the relative position of the left, right two ear pads 1' to the headband 2' to suit their head outline and position of ears.

In said headphone, the transfer of the audio signal is achieved via the lead, wherein, the earphone plug (not shown) is inserted into the audio player, computer, MP3, for example, the received audio signals are input into the ear pads 1' through the earphone plug interface 6' via the left, right audio signal wires and the common ground wire. Specifically, the earphone plug interface 6' arranged on the left ear pad, for example, the left channel audio signal wire and the common ground wire are connected with the speaker in the left ear pad electrically, and the right channel audio signal wire and the common ground wire are connected to the speaker in the right ear pad electrically meanwhile. In the headphone as shown in FIG. 1, electrically connecting the right channel audio signal wire and the common ground wire with the speaker in the right ear pad is achieved as follows: the lead 5' (the lead herein refers to the cable containing the audio signal wire and the common ground wire and externally wrapped with the insulating wrapper) penetrates out from the left ear pad and extends into the headband 2' through the fixing component 4' at the left side, then, penetrates out from the other end of the headband 2' and extends into the right ear pad 1' through the fixing component 4' at the right side.

However, there are following disadvantages in the headphone with the structure: the lead 5' between the left, right two ear pads 1' and the headband 2' are exposed so the structure is complex and disordered. In addition, due to the repeatedly sliding, stretching and contracting of the holder 3' and the put-on or take-off operation of the user, the exposed lead 5' is pulled and bent frequently therewith, when the number reaches a certain level, the lead 5' is easy to damage to cause the broken circuit and further influence the use of the earphone.

DESCRIPTION OF THE INVENTION

The technical issue to be solved by the utility model is providing a simple headphone that is not easy to turn off.

To solve the technical issue, the utility model provides a headphone, comprising a headband, left and right two ear pads and a holder. Two ends of the headband are separately provided with a fixing component, the fixing component includes a conductor block; the holder is made of the conductive material, of which one end is respectively connected with the left and right two ear pads fixedly and the other end is respectively connected with the fixing components in a sliding way, and the conductor block is pressed against the holder; in the ear pads, the first group of signal wires is connected to the holder electrically; in the fixing components, the second group of signal wires is connected with the conductor block electrically.

Furthermore, the holder includes the first slide way and the second slide way; at least one conductor block is pressed against the first slide way and the second slide way respectively.

Furthermore, each of the first group of signal wires and second group of signal wires includes an audio signal wire and a common ground wire, wherein the audio signal wire in the first group of signal wires is electrically connected with the first slide way of the holder, the audio signal wire in the second group of signal wires is electrically connected with the conductor block pressed against the first slide way; the common ground wire in the first group of signal wires is electrically connected with the second slide way of the holder, and the common ground wire in the second group of signal wires is electrically connected with the conductor block on the second slide way.

Furthermore, the audio signal wires are the left channel audio signal wire or the right channel audio signal wire.

Furthermore, both the holder and conductor block are made of metal.

Furthermore, the fixing component further includes a holder fixing seat and a pivot fixing cover, the holder fixing seat can be rotatably connected with the pivot fixing cover, and the holder is connected with the holder fixing seat in a sliding way.

Furthermore, the holder fixing seat includes a holder fixing upper seat and a holder fixing lower seat, the holder fixing upper seat is opened, the holder fixing lower seat is slotted on the corresponding position, the first slide way and second slide way of the holder are respectively arranged in the slot and pass through the opening.

Furthermore, the fixing component further includes a spring sleeved on the conductor block, one end of the spring is fixedly connected with the slot, the conductor block further comprises a pressing part and a sleeving part, the pressing part is pressed against the slide way accommodated in the slot and the sleeving part is accommodated in the spring.

Furthermore, the pivot fixing cover includes a pivot fixing lower cover and a pivot fixing upper cover, the pivot fixing lower cover includes a lower locking plate, two ends of the lower locking plate at the same side are respectively added with an end cover, the holder fixing seat is accommodated between the two end covers, the pivot fixing upper cover includes an upper locking plate, a connecting arm extends out from two ends of the upper locking plate at the same side respectively, and the connecting arms are connected with the end covers.

Furthermore, the end of the headband is fixedly connected between the upper locking plate and the lower locking plate.

The headphone provided in the utility model replaces the exposed lead with the conductive holder as the medium for the audio signal transfer between the left and right two ear pads, thus eliminating the exposed lead on the headphone, simplifying the structure and avoiding the risk of broken circuit due to the damage of the exposed lead in use previously.

BRIEF INTRODUCTION OF THE DRAWINGS

To describe the technical solution in the embodiments of the utility model or in the prior art, the necessary drawings in the embodiments or the prior art are briefly introduced, obviously, the drawings described below are only some embodiments of the utility model, the skilled in the art can obtain the other drawings based on the drawing without paying the creative work.

DETAILED DESCRIPTION OF THE PREFERRED EMBODIMENTS

Figure 1:
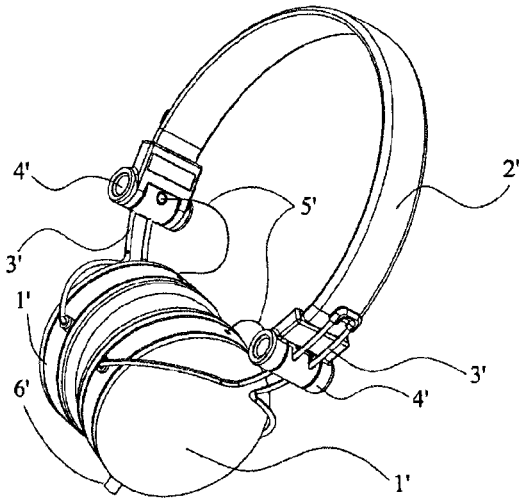
BACKGROUND ART Fig. 1
FIG. 1 is the structural schematic view of the existing headphone.

The preferred embodiments of the utility model are described with referring to the drawing as follows.

The headphone in the embodiment of the utility model, based on the structure of the existing headphone as shown in FIG. 1, replaces the exposed lead 5' with the conductive holder as the medium for the audio signal transfer between the left and right two ear pads, thus eliminating the exposed lead on the headphone, simplifying the structure and avoiding the risk of broken circuit due to the damage of the exposed lead in use previously.

Figure 2:
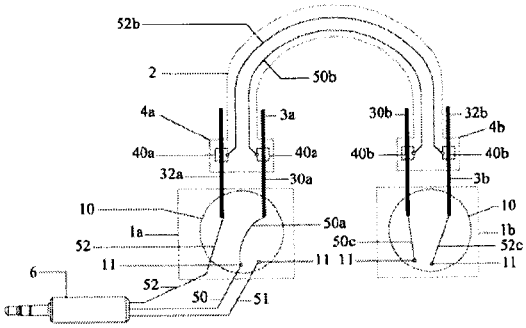
FIG. 2 is the structural principle schematic view of the present headphone in the embodiments of the utility model.

The structural principle schematic view of the headphone in the embodiments of the utility model is as shown in FIG. 2. One end of the earphone plug 6 is electrically connected with the audio player, and the received audio signals are input into the ear pads through the signal wire. With using the audio signal firstly transferred to the left ear pad 1*a* as an example, the signal wires includes a common ground wire 50, a left channel audio signal wire 51 and a right channel audio signal wire 52. The left ear pad 1*a* is internally provided with a speaker 10, the common ground wire 50 and the left channel signal wire 51 are respectively electrically connected with the speaker 10 in the left ear pad 1*a* through the welding spot 11 so as to provide the audio signal for the left ear pad 1*a* and make the user hear the audio through the left ear pad 1*a*. Meanwhile, to make the right ear pad 1*b* also provide the audio signal and the user hear the audio through the right ear pad 1*b*, it is necessary to transfer the signals of the common ground wire 50 and the right channel audio signal wire to the right ear pad 1*b*. The embodiments of the utility model are as follows: the holder 3*a* includes two slide ways 30*a*, 32*a* each having a sliding end and fixed end, wherein the sliding end is connected with the fixing component 4*a* in a sliding way, the fixed end extends into the left ear pad 1*a* and connected with the left ear pad fixedly. The right channel audio signal wire 52 is electrically connected with the fixed end of the first slide way 32*a* via the lead (for description convenience, the lead is called as the right channel audio signal wire 52*a*), and the common ground wire 50 is electrically connected to the fixed end of the second slide way 30 from the welding spot 11 (whether four welding spots 11 should be respectively numbered) (for description convenience, the lead is called as the common ground wire 50*a*) respectively, both the slide ways are conductive such that the whole slide ways 30*a*, 32*a* are respectively used as the extension of the common ground wires (50, 50*a*) and right channel audio signal wire 52 in the left ear pad 1*a* to transfer the signals out of the left ear pad 1*a* through the slide ways 30*a*, 32*a*. The fixing component 4*a* is internally provided with a conductor block 40*a* which is pressed against the slide ways 30*a*, 32*a* of the holder 3*a*, due to the sliding connection between the holder 3*a* and the fixing component, when the holder slides relative to the fixing component 4*a*, the slide ways 30*a*, 32*a* always keeps the sliding contact with the conductor block 40*a*, thus the conductor block 40*a* can obtain the signals from the slide ways 30*a*, 32*a*. The conductor block 40*a* is further connected with the lead, the slide way 30*a* is used as the extension of the common ground wires (50,50*a*) in the left ear pad 1*a*, so the part of the lead connected with the conductor block is also called as the common ground wire, for description convenience, the part of the common ground wire is marked as 50*b*; similarly, the lead connected with the conductor block 40*a* pressed against the slide way 32*a* is also called as the right channel audio signal wire 52*b*. Both the common ground wire 50*b* and the right channel audio signal wire 52*b* are arranged in the headband, and the headband is designed to be the approximately arched shape to suit the human head outline.

The other end of the headband 2 is equipped with a fixing component 4*b* that is exactly the same with the fixing component 4*a* in structure. One end of the conductive holder 3*b* that is exactly the same with the holder 3*a* in structure passes through the fixing component 4*b* and is connected with the fixing component 4*b* in a relative sliding way, the other end of the holder 3*b* is connected with the right ear pad 1*b*. the fixing component 4*b* is provided with a conductor block 40*b* which is respectively connected with the common ground wire 50*b* and the right channel audio signal wire 52*b* electrically. The holder 3*b* is connected with the fixing component 4*b* in a sliding way, the conductor block 40*b* is pressed against the holder 3*b*, when the holder 3*b* slides relative to the fixing component 4*b*, the holder 3*b* always keeps the sliding contact with the sliding contact with the conductor block 4*b*. Specifically, the holder 3*b* includes two slide ways 30*b*, 32*b*, the conductor block 40*b* are respectively pressed against the slide ways 30*b*, 32*b*. In this way, the signals obtained by conductor block 40*b* from the common ground wire 50*b* and the right channel audio signal wire can be separately transferred to the slide ways 30*b* and 32*b*. Like the slide ways 30*a*, 32*a* of the holder 3*a*, the slide ways 30*b*, 32*b* of the holder 3*b* are used as the medium of the signal transfer. The tail ends extends into the right ear pad 1*b* from the slide ways 30*b*, 32*b* are respectively connected with the lead electrically, namely the common ground wire 50*c*, the right channel audio signal wire 52*c* are connected with the speaker 10 in the right ear pad 1*b* through the welding spot 11 electrically. Thus, the signal is transferred from the left ear pad 1*a* to the right ear pad 1*b* and the user can hear the audio through the right ear pad. For example, the right channel audio signal can be transferred from the left ear pad 1*a* to the right ear pad, as it were, through the lead 52, the slide way 32*a*, the lead 52*b*, the slide way 32*b* and the lead 52*c* respectively, or through the leads between the left and right ear pads, only the lead between the ear pad and the fixing component is replaced with the slide way of the holder. In the same way, so is the common ground wire.

Figure 3:
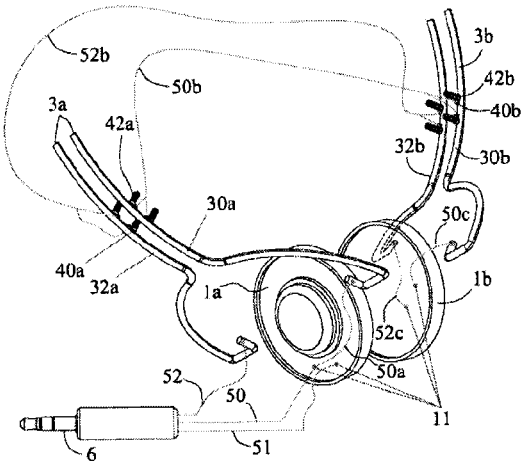
FIG. 3 is the structural schematic view of the present headphone in the embodiments of the utility model.

FIG. 3 is the specific structural schematic view provided based on the principle as shown in FIG. 2. As with the FIG. 2, the audio signal is firstly transferred to the left ear pad 1*a* through the earphone plug 6, for example, the signal wire includes the common ground wire 50, the left channel audio signal wire 51 and the right channel audio signal wire 52. The left ear pad 1 a is internally equipped with the speaker, the common ground wire 50 and the left channel audio signal wire 51 are electrically connected with the speaker in the left ear pad 1*a* through the welding spot 11 so as to provide the audio signal to the left ear pad 1*a* and make the user hear the audio through the left ear pad 1*a*. The holder 3*a* includes two slide ways 30*a*, 32*a* each having a sliding end and fixed end, wherein the sliding end is connected with the fixing component (not shown) in a sliding way, the fixed end extends into the left ear pad 1*a* and connected with the left ear pad fixedly. The sliding ends of the two slide ways 30*a*, 32*a* are parallel to each other and the spacing length thereof suits the fixing component; the fixed end is outwards protruded and slightly arched to suit the outline of the left ear pad 1*a*. In the left ear pad 1*a*, the right channel audio signal wire 52 is directly electrically connected with the fixed end of the slide way 32*a*, the common ground wire 50*a* is led out from the welding spot 11 and electrically connected with the fixed end of the slide way 30*a*. At least one conductor block 40*a* is pressed against the sliding ends of the slide ways 30*a*, 32*a*, as shown in FIG. 3, there are two conductor blocks 40*a* pressed against the sliding ends of the slide ways 30*a*, 32*a* respectively. Two conductor blocks 40*a* on the same slide way are respectively electrically connected with two leads that are combined into one lead for transfer, for example, two leads electrically connected with the two conductor blocks 40*a* on the slide way 30*a* are combined into the common ground wire 50*b*; the two leads electrically connected with the two conductor blocks 40*a* on the slide way 32*a* are combined into the right channel audio signal wire 52*b*, the advantage thereof compared with one conductor arranged on one slide way is: when the lead and one conductor block are poor contact or the conductor block falls off etc., the other conductor block can still obtain the electric signal from the slide way so as to ensure the smoothness of the signal transfer. The conductor block 40*a* is sleeved by the spring 42*a* externally, the conductor block 40*a* is closely pressed against the slide way via the elasticity of the spring 42*a*, so the two parts are adhered tightly and always keep the contact during the sliding process, thus the conductor block 40*a* can obtain the electric signal from the slide way normally. Two leads are respectively divided from the portions on the right channel audio signal wire 52*b* and the common ground wire 50*b* closing to the conductor block and electrically connected to the slide ways 32*b* and 30*b*, for example, the two leads divided from the right channel audio signal wire 52*b* are respectively electrically connected to the two conductor block 40*b* on the slide way 32*b*; the two leads divided from the common ground wire 50*b* are respectively electrically connected to the two conductor block 40*b* on the slide way 32*b*. in the right ear pad 1*b*, one end of one lead is electrically connected with the fixed end of the slide way 32*b* to obtain the electric signal from the slide way 32*b* and the other end is electrically connected with the speaker in the right ear pad 1*b*, the lead is the right channel audio signal wire 52*c*. One end of the other lead is electrically connected with the fixed end of the slide way 30*b* to obtain the electric signal from the slide way 30*b* and the other end is connected with the speaker in the right ear pad 1*b* electrically, the lead is the common ground wire 50*c*.

To be sure, the left ear pad 1*a* and the right ear pad 1*b*, the holders 3*a* and 3*b*, the slide ways 30*a*, 30*b*, 32*a*, 32*b*, the fixing components 4*a* and 4*b*, the conductor blocks 40*a* and 40*b*, the springs 42*a* and 42*b* are the same in structure, which are marked and distinguished by a and b to make the corresponding description more clear.

As mentioned above, the connection relationship of the leads, slide ways and conductor blocks is: in the left ear pad or the right ear pad, the first group of signal wire is electrically connected with the holder 3; in the fixing component 4, the second group of signal wire is electrically connected with the conductor block 40. Specifically, both the first group of signal wires and the second group of signal wires include an audio signal wire and a common ground wire respectively, wherein the audio signal wire in the first group of signal wires is electrically connected with the first slide way 32 of the holder 3, the audio signal wire in the second group of signal wires is electrically connected with the conductor block 40 pressed against the first slide way 32; the common ground wire in the first group of signal wires is electrically connected with the second slide way 30 of the holder 3, and the common ground wire in the second group of signal wires is electrically connected with the conductor block 40 on the second slide way 30. The second group of signal wires is arranged in the headband 2. Certainly, as for the headphone provided in the embodiments of the utility model, there are two first groups of signal wires which are separately arranged in the left ear pad and the second ear pad. If the audio signal in the first group of signal wires is the right channel audio signal wire, the left channel audio signal wire is directly electrically connected with the speaker in the left ear pad, the right channel audio signal wire is electrically connected with the first slide way of the left holder (connected with the left ear pad) in the left ear pad, the audio signal wire in the second group of signal wires is also the right channel audio signal wire of which one end is electrically connected with the conductor block pressed against the first slide way in the left fixing component (connected with the left holder) and the other end is electrically connected with the conductor block on the first slide way pressed against the right holder (connected with the right ear pad) in the right fixing component (connected with the right holder). If the audio signal wire in the first group of signal wires is the left channel audio signal wire, the situation is similar so as to repeat no more here.

Figure 4:
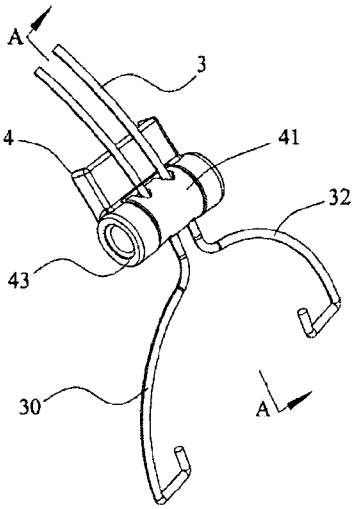
FIG. 4 is the assembly stereogram of the fixing component and holder of the headphone in the embodiments of the utility model.
Figure 5:
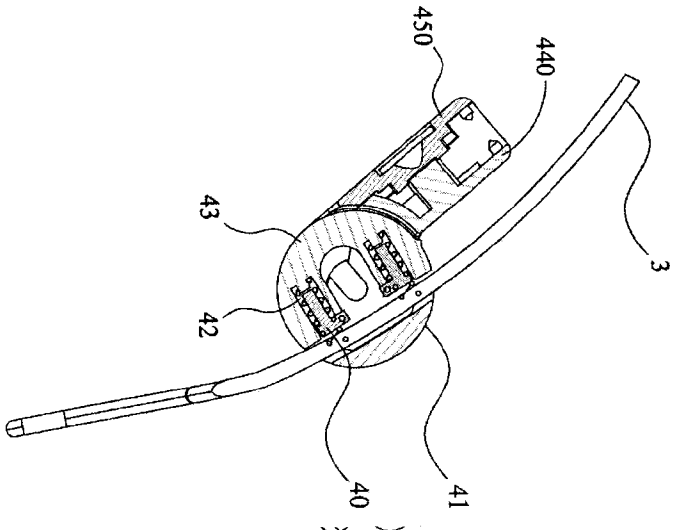
FIG. 5 is the cross-section schematic view along A-A as shown in FIG. 4.
Figure 6:
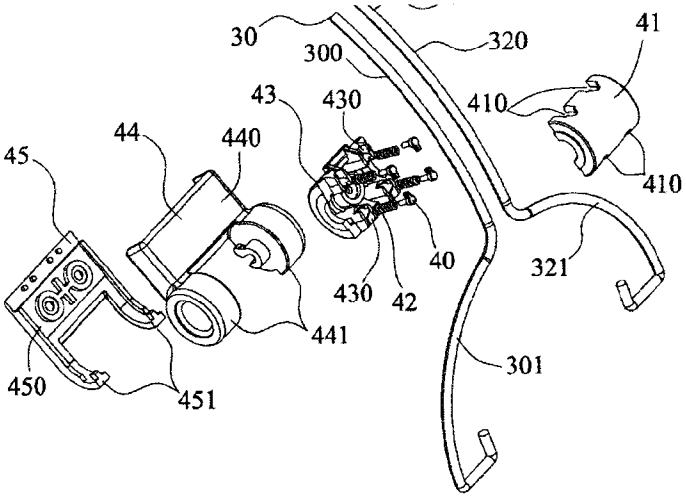
FIG. 6 is the exploded assembly stereogram of the fixing component and holder of the headphone in the embodiments of the utility model.

Please refer to FIG. 4-6 at the same time, FIG. 4 is the assembly stereogram of the fixing component and holder of the headphone in the embodiments of the utility model; FIG. 5 is the cross-section schematic view along A-A as shown in FIG. 4; FIG. 6 is the exploded assembly stereogram of the fixing component and holder of the headphone in the embodiments of the utility model.

The fixing component 4 includes a holder fixing seat and a pivot fixing cover, the holder fixing seat is cylindrical and further includes a holder fixing upper seat 41 and a holder fixing lower seat 43, the pivot fixing cover further includes a pivot fixing lower cover 44 and a pivot fixing upper cover 45.

The slide way 30 of the holder 3 includes a sliding end 300 and a fixed end 301, the slide way 32 includes a sliding end 320 and a fixed end 321, wherein the holder fixing upper seat 41 and holder fixing lower seat 43 can be locked to accommodate the sliding ends 300 and 320 therein, and the sliding ends 300 and 320 can slide in the holder fixing seat to and fro. The top and bottom of the holder fixing upper seat 41 are respectively opened 410 and the holder fixing lower seat 43 is slotted on the corresponding positions. The conductor block 40 includes a pressing part and a sleeving part, the pressing part is pressed against the sliding end of the slide way and the sleeving part is arranged in the spring 42, one end of the spring 42 is fixedly connected with the slot 430. When the holder fixing upper seat 41 and the holder fixing lower seat 43 are locked, the sliding ends 300 and 320 of the holder 3 are placed in the slot 430, the conductor block 40 sleeved with the spring 42 is arranged between the sliding ends 300 and 320 and the slot 430. Due to the locking function of the holder fixing seat, the spring 42 is pressed so that the pressing part of the conductor block 40 is pressed against the sliding ends 300 and 320 tightly. The sliding ends 300 and 320 respectively penetrate out from the opening 410 so as to achieve the sliding connection between the holder 3 and the fixing component 4, the sliding ends 300 and 320 always keep the close contact with the conductor block 40 during the sliding process.

The pivot fixing lower cover 440 includes a rectangular lower locking plate 440, two ends at the same side of the pivot fixing lower cover 440 are respectively provided with a circular end cover 441, the space between the two end covers 441 is used for accommodating the holder fixing seat. The semicircular holes on two ends of the holder fixing upper seat 41 and a holder fixing lower seat 43 separately clamp the hollow plastic shafts extending from the two end covers 441 so that the holder fixing seat can rotate around the pivot fixing cover and further drive the holder and ear pads to rotate, thus the user can adjust based on the wearing habit. The pivot fixing upper cover 45 includes a rectangular upper locking plate 450, an arched connecting arm 451 respectively extends out from two ends at the same side of the upper locking plate 450, and the connecting arms 451 are connected with the end covers 441. When the pivot fixing upper cover 45 and the pivot fixing lower cover 44 are locked, the upper locking plate 450 and the lower locking plate 440 can fix the end of the headband 2 therebetween, thus the fixing component 4 is fixedly connected with the headband.

The disclosure mentioned above is the preferred embodiments of the utility model only and cannot limit the scope of claims of the utility model, therefore, the equivalent changes based on the claims of the utility model are still to be embraced within the scope of the utility model.

The invention claimed is:

1. A headphone, comprising a headband, left and right two ear pads and a holder, wherein two ends of the headband are separately provided with a fixing component, the fixing component includes a conductor block; the holder is made of the conductive material, of which one end is respectively connected with the left and right two ear pads fixedly and the other end is respectively connected with the fixing components in a sliding way, and the conductor block is pressed against the holder; in the ear pads, the first group of signal wires is connected to the holder electrically; in the fixing components, the second group of signal wires is connected with the conductor block electrically.

2. The headphone as claimed in claim 1, wherein the holder includes the first slide way and the second slide way; at least one conductor block is pressed against the first slide way and the second slide way respectively.

3. The headphone as claimed in claim 2, wherein each of the first group of signal wires and second group of signal wires includes an audio signal wire and a common ground wire, wherein the audio signal wire in the first group of signal wires is electrically connected with the first slide way of the holder, the audio signal wire in the second group of signal wires is electrically connected with the conductor block pressed against the first slide way; the common ground wire in the first group of signal wires is electrically connected with the second slide way of the holder, and the common ground wire in the second group of signal wires is electrically connected with the conductor block on the second slide way.

4. The headphone as claimed in claim 3, wherein the audio signal wires are the left channel audio signal wire or the right channel audio signal wire.

5. The headphone as claimed in claim 1, wherein both the holder and conductor block are made of metal.

6. The headphone as claimed in claim 2, wherein the fixing component further includes a holder fixing seat and a pivot fixing cover, the holder fixing seat can be rotatably connected with the pivot fixing cover, and the holder is connected with the holder fixing seat in a sliding way.

7. The headphone as claimed in claim 6, wherein the holder fixing seat includes a holder fixing upper seat and a holder fixing lower seat, the holder fixing upper seat is opened, the holder fixing lower seat is slotted on the corresponding position, the first slide way and second slide way of the holder are respectively arranged in the slot and pass through the opening.

8. The headphone as claimed in claim 7, wherein the fixing component further includes a spring sleeved on the conductor block, one end of the spring is fixedly connected with the slot, the conductor block further comprises a pressing part and a sleeving part, the pressing part is pressed against the slide way accommodated in the slot and the sleeving part is accommodated in the spring.

9. The headphone as claimed in claim 6, wherein the pivot fixing cover includes a pivot fixing lower cover and a pivot fixing upper cover, the pivot fixing lower cover includes a lower locking plate, two ends of the lower locking plate at the same side are respectively added with an end cover, the holder fixing seat is accommodated between the two end covers, the pivot fixing upper cover includes an upper locking plate, a connecting arm extends out from two ends of the upper locking plate at the same side respectively, and the connecting arms are connected with the end covers.

10. The headphone as claimed in claim 9, wherein the end of the headband is fixedly connected between the upper locking plate and the lower locking plate.

* * * * *